US009653788B2

(12) United States Patent
Lerchner

(10) Patent No.: US 9,653,788 B2
(45) Date of Patent: May 16, 2017

(54) ROOF-MOUNTED ANTENNA ARRANGEMENT

(71) Applicant: KATHREIN Automotive GmbH & Co. KG, Hildesheim (DE)

(72) Inventor: Henry Lerchner, Hannover (DE)

(73) Assignee: KATHREIN Automotive GmbH & Co. KG, Hildesheim (DE)

( * ) Notice: Subject to any disclaimer, the term of this patent is extended or adjusted under 35 U.S.C. 154(b) by 57 days.

(21) Appl. No.: 14/706,069

(22) Filed: May 7, 2015

(65) Prior Publication Data

US 2015/0325906 A1 Nov. 12, 2015

(30) Foreign Application Priority Data

May 8, 2014 (DE) ..... 20 2014 003 956 U

(51) Int. Cl.

| | |
|---|---|
| ***H01Q 1/32*** | (2006.01) |
| ***H01Q 1/42*** | (2006.01) |
| ***H01Q 1/38*** | (2006.01) |
| ***H01Q 9/32*** | (2006.01) |

(52) U.S. Cl.

CPC ..... *H01Q 1/3275* (2013.01); *H01Q 1/38* (2013.01); *H01Q 1/42* (2013.01); *H01Q 9/32* (2013.01)

(58) Field of Classification Search

CPC ..... H01Q 1/3275; H01Q 1/38; H01Q 1/42; H01Q 9/32

USPC ..... 343/704, 711, 712, 713

See application file for complete search history.

(56) References Cited

U.S. PATENT DOCUMENTS

| | | | | |
|---|---|---|---|---|
| 6,999,032 | B2 * | 2/2006 | Pakray | H01Q 1/3275 343/700 MS |
| 7,239,281 | B2 * | 7/2007 | Lu | H01Q 1/3275 343/711 |
| 8,248,315 | B2 * | 8/2012 | Lindackers | H01Q 1/1207 343/705 |
| 9,178,266 | B2 * | 11/2015 | Burg | H01Q 1/3275 |
| 2006/0038726 | A1 | 2/2006 | Iacovella et al. | |
| 2007/0103374 | A1 | 5/2007 | Lindackers et al. | |
| 2008/0012776 | A1 * | 1/2008 | Blickle | H01Q 1/1214 343/713 |

FOREIGN PATENT DOCUMENTS

| | | |
|---|---|---|
| DE | 20 2005 017 773 | 3/2006 |
| DE | 10 2005 054 286 | 5/2007 |
| DE | 10 2007 054 141 | 5/2009 |
| DE | 20 2009 003 448 | 7/2009 |
| DE | 10 2009 012 641 | 9/2010 |
| DE | 10 2009 051 605 | 5/2011 |
| DE | 10 2012 208 303 | 11/2013 |

* cited by examiner

*Primary Examiner* — Tho G Phan

(74) *Attorney, Agent, or Firm* — Nixon & Vanderhye P.C.

(57) ABSTRACT

The space below the hood of a vehicle is used for the positioning of a vertical plate part of thin profile mobile antenna structures. The ground reference can be added directly in the form of the base plate.

14 Claims, 11 Drawing Sheets

-- PRIOR ART --

ROOF-MOUNTED ANTENNA ARRANGEMENT

CROSS-REFERENCE TO RELATED APPLICATIONS

None.

STATEMENT REGARDING FEDERALLY SPONSORED RESEARCH OR DEVELOPMENT

None.

FIELD

This application claims priority to German Patent Application No. 20 2014 003 956.9 filed 8 May 2014, the entire contents of which is hereby incorporated by reference.

The invention relates to a roof-mounted antenna arrangement for motor vehicles according to the preamble of claim 1.

Arrangements of this kind contain at least the antennae for mobile communications, i.e. in Europe in the ranges of 0.9 and 1.8 GHz. An antenna for GPS is then often a first addition and, depending on need and desire, completions with antennae for further services are also common.

BACKGROUND AND SUMMARY

However, for reasons of space and on account of the necessary decorrelation of the radiators from one another, the configuration and the number of the antennae under the same cover are limited. Likewise, for example official regulations regarding the dimensions of the cover (as an attachment, overall height especially) and structural requirements from the designer must be taken into account.

With regard to the overall height of the cover, problems arise in particular from the actual design and the positioning of the mobile communication antennae, and here especially of the radiator for the 900 MHz range. The antenna should have an all-round characteristic in the horizontal radiated field pattern and would optimally be configured as a monopole. If the overall height of a monopole of this kind and that of the other structural components of the arrangement to be positioned one above the other on the vehicle roof was now added together, then a dimension would result for the entire arrangement which is greater than the 70 mm permissible according to regulations.

Even if the conventional folded or similarly structured configuration of the radiator for the 900 MHz range appears to achieve, overall, the necessary electrically effective height, this still leaves a great deal to be desired. This is because, to the same extent that the geometrical dimensions of the structure are reduced, reductions in RF function and quality also generally become increasingly difficult to avoid.

Corresponding motor vehicle antennae, frequently provided with a fin-like covering cap, are known from a large number of prior publications.

DE 10 2009 051 695 A1 for example describes an antenna arrangement in which the vertical board comprising an antenna is arranged above a base plate. A solution which is comparable in this respect is also known from DE 20 2005 017 773 U1. The horizontal boards generally comprise a through-opening merely for the connection to the electronics, through which opening a lug or tab of the respective board, which is vertically arranged and provided with an antenna arrangement, can project beneath the plane of the horizontal board.

US 2006/0038726 A1 describes a vertical monopole antenna, the lower rim or lower edge of which extends as far as the surface of a base or of a pedestal supporting the entire antenna.

The same also applies to the antenna arrangement known from US 2007/0103374 A1.

In contrast, the object of the invention is to provide more scope for improvements in the configuration, and thus the effectiveness, of specific antennae beneath the cover, in particular the mobile communication antennae, by means of design measures with regard to individual elements of the roof-mounted antenna arrangement.

The object is achieved according to the invention in accordance with the features set out in claim 1. Advantageous embodiments are specified in the dependent claims.

In the invention, the space beneath the cover which can be used for positioning a vertical board part having antenna structures extends downwards towards the base plate, while retaining the outer dimensions of the cover. In this case, the ground reference can be specified directly in the design of the base plate. For example, the vertical surface available for the antenna increases in height by 5 mm or more, depending on the dimensions which would otherwise arise from the thickness of the horizontal board and the space beneath which is required for the components.

In the context of the invention, it is therefore proposed that the base plate, i.e. the pedestal or the base, which receives and supports the entire antenna, comprises a recess in the base region thereof, so that the lower edge of the vertical board is arranged beneath the base surface which points upwards and is formed by the bottom of the base plate.

In this respect, the invention in part also refers to skeletonising the base plate, i.e. a measure by means of which the desired opening is produced, so that the vertical board comprising an antenna arrangement can be positioned even lower.

Thus, when skeletonising the base plate is also provided as explained above, further or additional gains in height for the configuration of an antenna structure are made compared with the prior art. The skeletonising is possible in part as far as the planar part of the base plate which is required for arranging the means, which are known per se, for mounting and retaining the attachment above the opening in the roof surface. Thus, a frame is retained from the remaining portion of the base plate, which frame provides the border for the assembly with the cover, and a circumferential seal, and to which the board portions comprising the antennae and the circuit can be fixed. In the variant of the invention having a skeletonised base plate, the metal roof surface of the vehicle can directly serve as the ground plane for the antennae.

The invention provides the option of either installing the vertical board comprising the antenna structure lower down in order to reduce the overall height of the roof-mounted antenna arrangement to equal the outer height of the fin cover, or of enlarging upwards the surface of the vertical board beneath the cover while maintaining a predetermined cover size. Last but not least, when implementing the arrangement according to the invention, savings can also be made at least with respect to the board material and, when including the base plate, also with respect to the proportion of metal, together with a reduction in weight.

BRIEF DESCRIPTION OF THE DRAWINGS

In the following, the invention will be described in greater detail with reference to the drawings, in which.

DETAILED DESCRIPTION OF NON-LIMITING EMBODIMENTS

Figure 5:
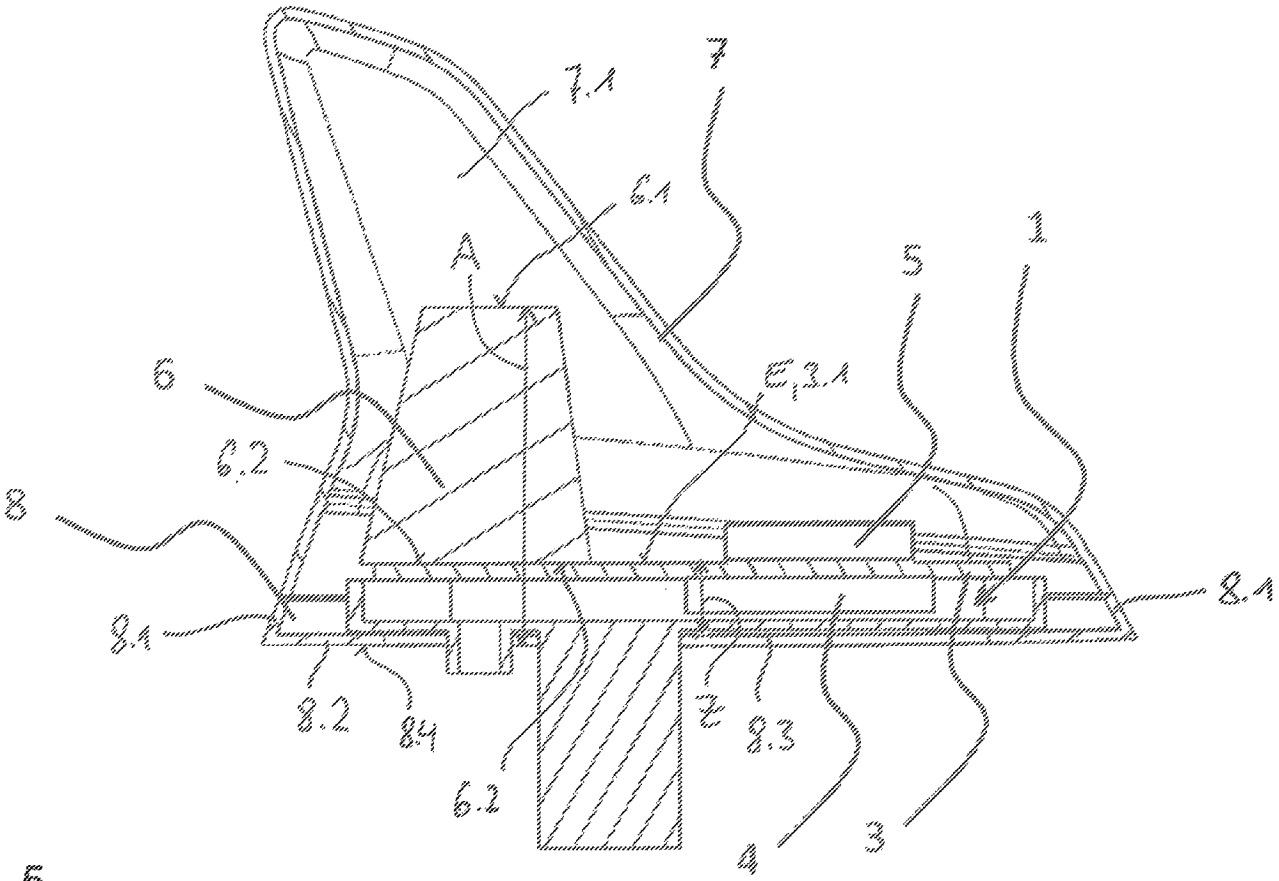
FIG. 5 is a vertical section through a motor vehicle roof-mounted antenna according to the prior art.

Reference is made in the following to FIG. 5, which shows a vertical longitudinal section of a roof-mounted antenna arrangement according to the prior art. This motor vehicle antenna arrangement comprises various components which are accommodated beneath a fin cover 7 or are covered by said cover. The components include a base plate or a pedestal 1, a horizontally arranged board 3 comprising circuits 4 (for example by means of an adapter circuit and/or amplifying circuit 4 for the antennae provided on the underside of the horizontal board 3), and an antenna 5 (for example a GPS antenna in the form of a patch antenna). In addition, a vertically arranged board 6 is provided, on which the conductive structures for a mobile communication antenna are formed. The antennae on the vertical board 6 are generally applied to the surface of the board as conductor tracks. Said vertically arranged board 6 is generally positioned in the vertical longitudinal plane of symmetry of the antenna arrangement, preferably following on from the further antenna 5 which is positioned in front on the horizontal board, specifically with the underside 6.2 thereof on the upper side 3.1 of the horizontal board 3.

As already mentioned, the height of the fin cover 7, which is considered to be an attachment according to official regulations, is restricted. When designing the antennae (for example at least in the case of GSM radiators for the 900 MHz range) it must further be taken into account that an effective length corresponding to a value of $\lambda/4$ is not achievable beneath the cover in terms of space ($\lambda$ typically being the centre frequency of the radiator). When forming a radiator of this kind on a board 6, corresponding precautions must therefore be taken with regard to the conductor track in order to achieve an actual lengthening of the radiator, for example by means of bending, folding and variations in cross-section. In the process, however, impairments of the RF functions are often unavoidable, in particular in the event of unfavourable conditions.

As usual, the entire arrangement comprising the pedestal 1, i.e. the base plate 1, and the structure located thereon is mounted on a vehicle roof (not shown in greater detail in FIG. 5) by means of a circumferential sealing arrangement 8. The seal 8 usually comprises a circumferential sealing portion which rests on a vehicle roof and has a sealing rim 8.1 which is provided circumferentially and projects upwards from the motor vehicle roof. The seal base 8.2 comprises a corresponding central opening 8.3. The cover 7 is then put on in the region of said seal, or is inserted at the circumferential rim, in order to protect and seal the cover interior 7.1 together with the components located beneath.

Figure 1A:
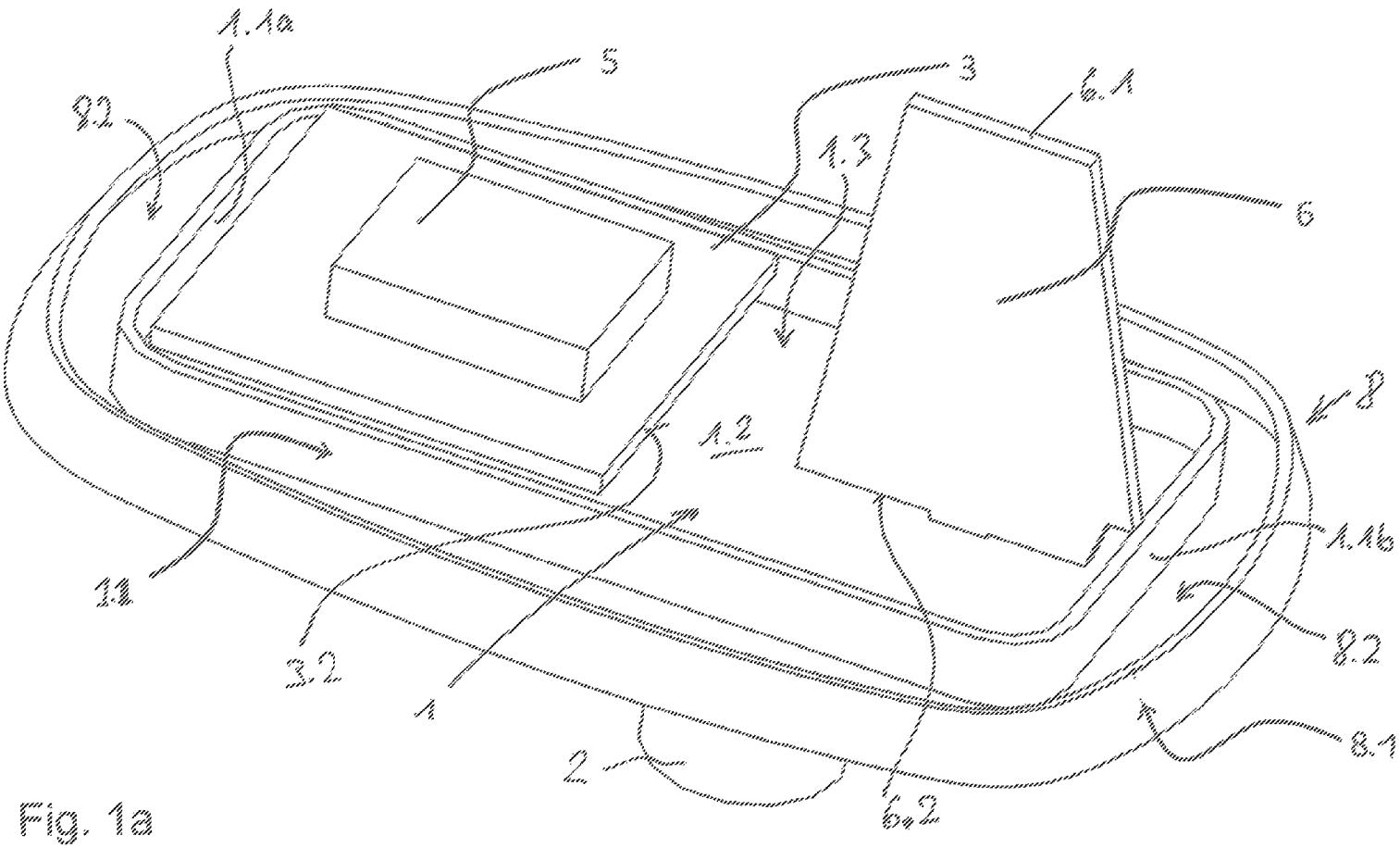
FIG. 1*a* is a perspective view of an example of a motor vehicle roof-mounted antenna which is not part of the invention.
Figure 1B:
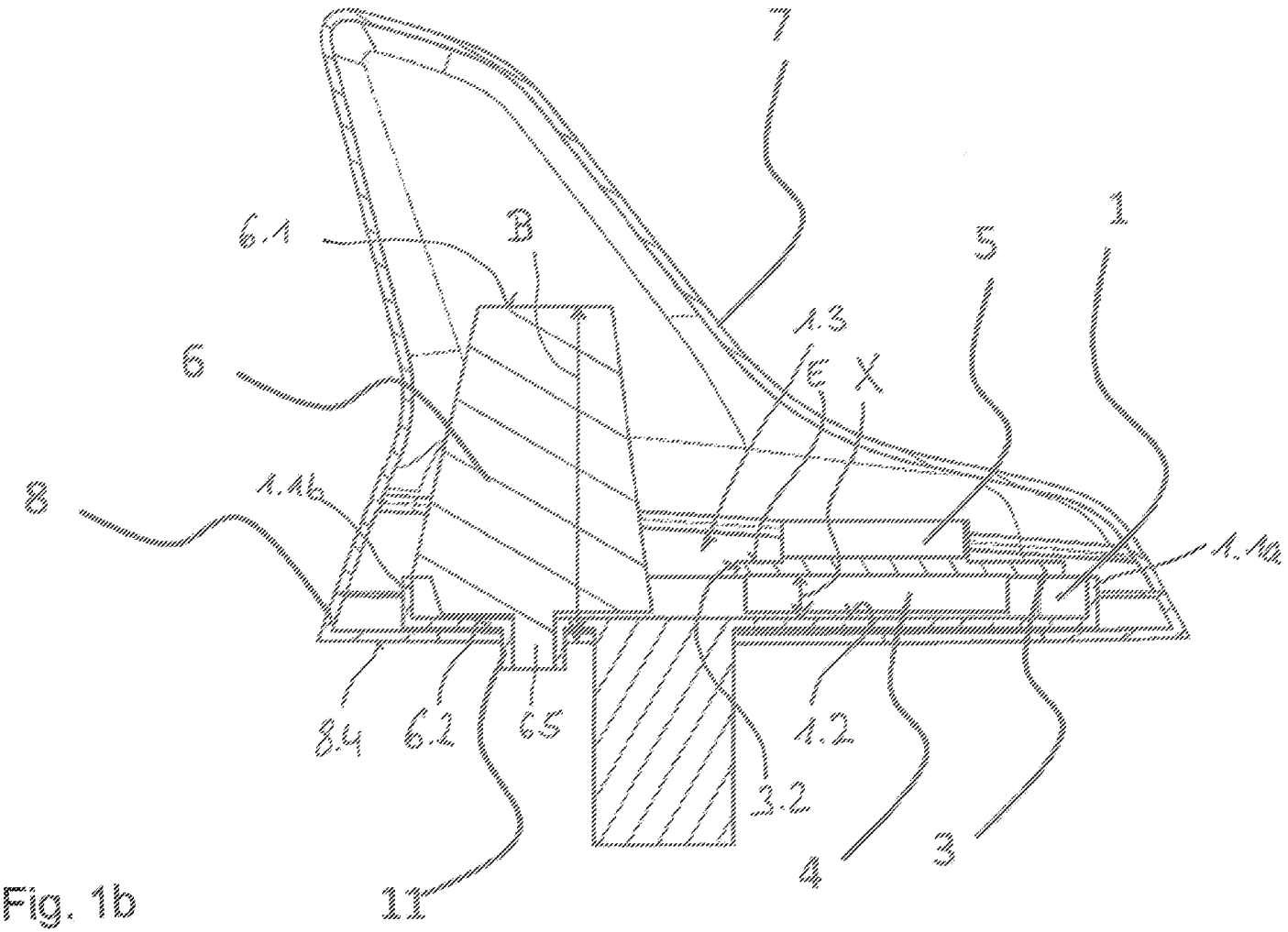
FIG. 1*b* is a vertical section through the example according to FIG. 1*a* when the cover is in place.
Figure 1C:
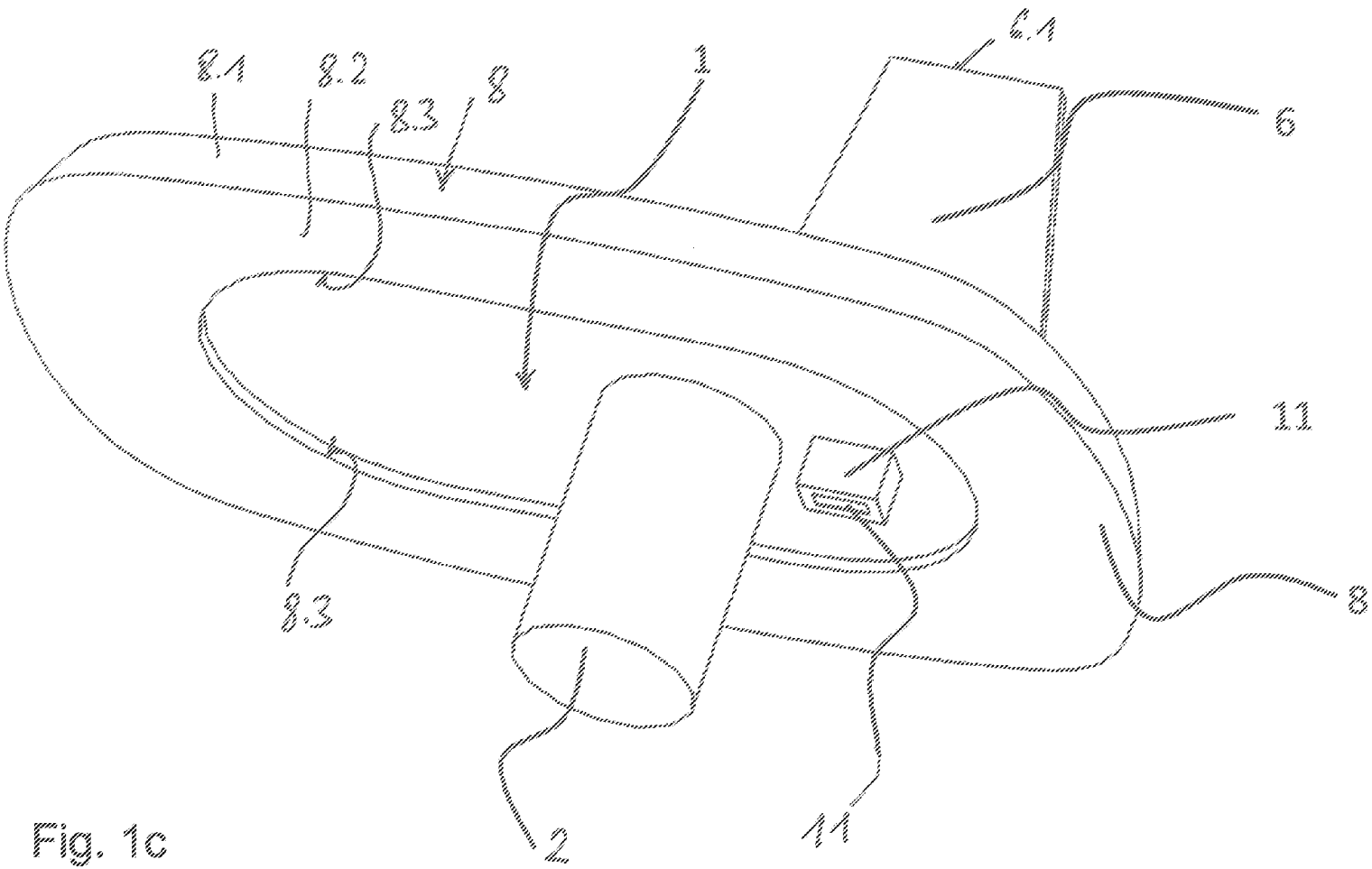
FIG. 1*c* is a perspective view from below of the example according to FIG. 1*a;*

As a distinction from this prior art according to the illustration according to FIG. 5, reference is now made to a first embodiment of the invention, which is shown in FIGS. 1*a* to 1*c*.

FIGS. 1*a* to 1*d* show how, in an example of an antenna which likewise is not part of the invention, a height dimension B relative to the plate 6 can be reduced compared with dimension A according to the arrangement known from the prior art (as described in FIG. 5) and how this can be done for a board 6 having essentially the same surface area and height which is used for a corresponding mobile communication radiator.

Conversely, this also means that the height of the board 6 can be increased, for example by the difference between the values A and B, if a cover is selected in the embodiment according to the invention according to FIGS. 1*a* to 1*c* which is identical to that in the example of FIG. 5 according to the prior art. In this case, the height dimension A or B is always measured from the underside or lower surface 8.4 of the seal 8 to the upper edge 6.1 of the vertical board 6.

In the variant according to FIGS. 1*a* to 1*d*, a horizontal board 3 is used which has a surface area which is reduced to the extent that the vertical board 6 can be placed directly on the base plate 1 and results in the dimension B which is reduced compared with the value A, or a possible increase in the height of the board 6 by the difference A−B.

In this case, it can be seen that the base plate 1, which is typically placed on a roof 41 of a motor vehicle and consists of an electrically conductive material or is coated with an electrically conductive material, can be provided for example with an inner circumferential rim or frame 1.1, inside which said horizontal board 3 is arranged at a small distance X above the bottom 1.2 of the base plate 1. The mentioned antenna 5, for example in the form of a GPS radiator, is positioned thereon.

The length of said horizontal board 3 is reduced such that the lower edge 6.2 of the mentioned vertical board 6 comprising the antenna formed thereon, in particular a mobile communication antenna, can now be placed directly on the bottom 1.2 of the base plate 1 in the interior 1.3 of the base plate 1 located above the bottom 1.2 of the base plate 1. In the process, a ground connection can also be established between the lower edge 6.2, which can be coated with an electrically conductive layer for example, and the electrically conductive bottom 1.2, and thereby with the base plate 1. Independently thereof, the base plate 1 forms the ground plane.

In other words, in this embodiment, the overall length of the horizontal board 4 and the vertical board 6 is less than the overall internal length available between a forward 1.1*a* and a following 1.1*b* base plate rim portion. The boundary side 3.2 of the horizontal boards facing the vertical board thus ends before the vertical board 6.

Figure 1D:
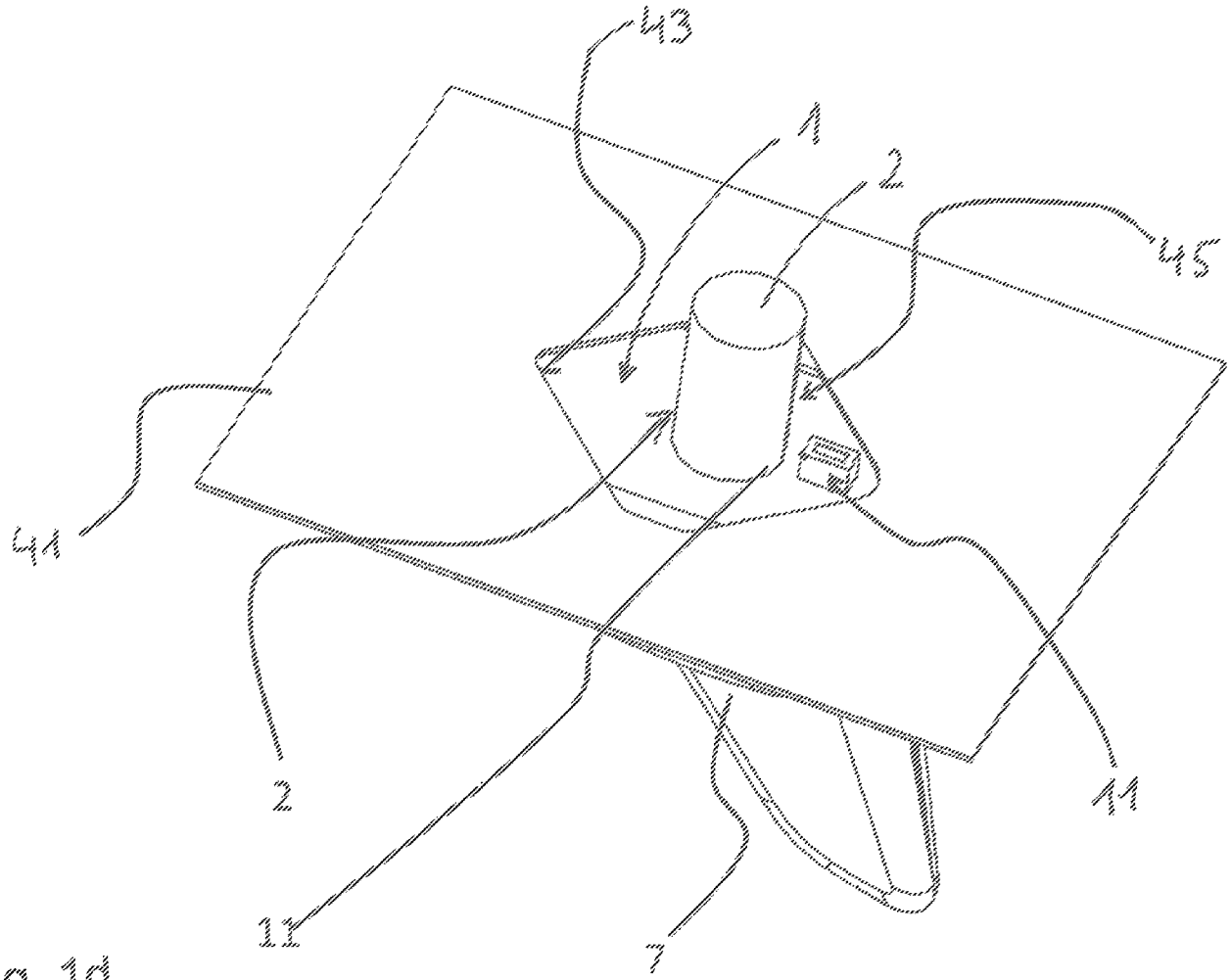
FIG. 1*d* is a further view from below of the example according to FIG. 1*a* to 1*c* showing a detail of a motor vehicle roof, comprising a roof opening, viewed from below.

FIG. 1*d* is a view from below of the interior of a motor vehicle in a detail of a motor vehicle roof 41 (in FIG. 1*d* said roof is merely shown in a rectangular detail). An opening 45 is made in said motor vehicle roof 41 which is delimited by opening edges 43. In the embodiment shown, said opening is at least approximately square, it also being possible for the transition into the corners to be tangential or round for example. When a motor vehicle antenna is correspondingly fitted, the fastening means (visible in FIG. 1*d*) for locking the antenna then project through the roof opening into the inside of the motor vehicle. It can also be seen from FIG. 1*d* that, in the region of the roof opening 45, the cuff (explained in more detail below) comprising a locking slot (formed on the underside of the base plate) projects through the opening 45 into the interior of the motor vehicle.

Figure 2A:
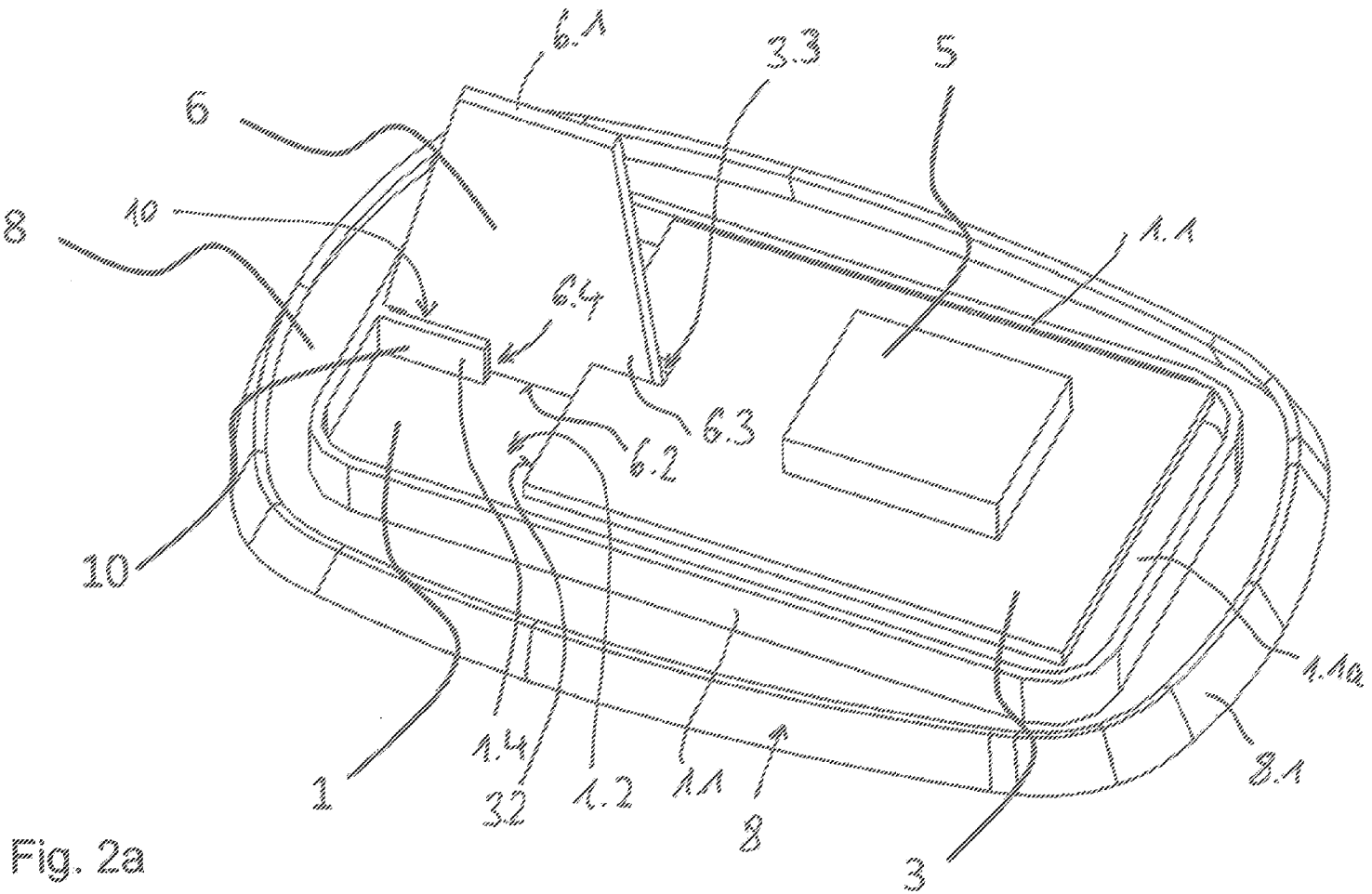
FIG. 2*a* is a view similar to FIG. 1*a* of an example which is slightly modified compared with FIG. 1*a*, and which is likewise not part of the invention.
Figure 2B:
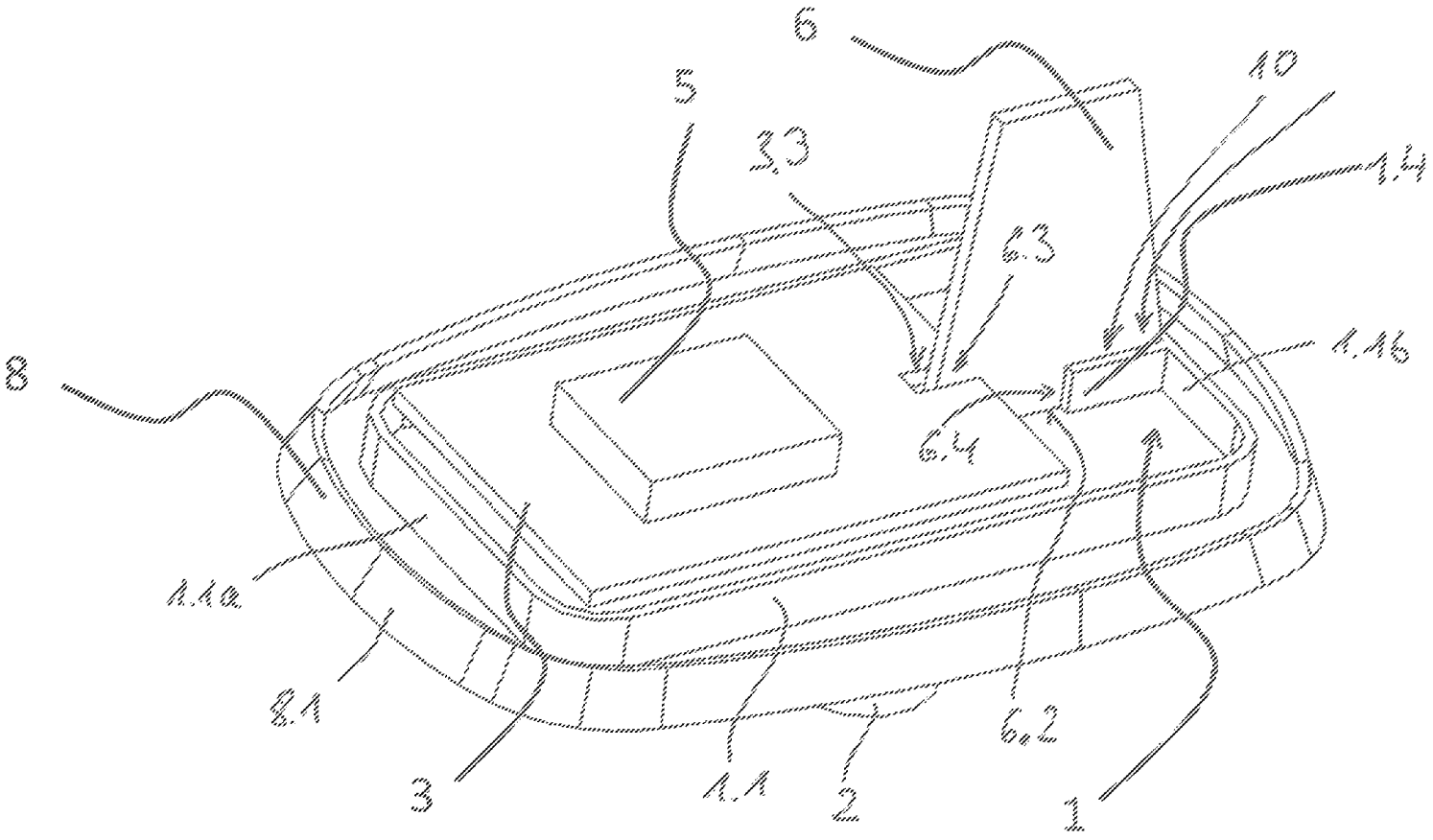
FIG. 2*b* is a view corresponding to FIG. 2*a*, but viewed from an opposing angle.
Figure 2C:
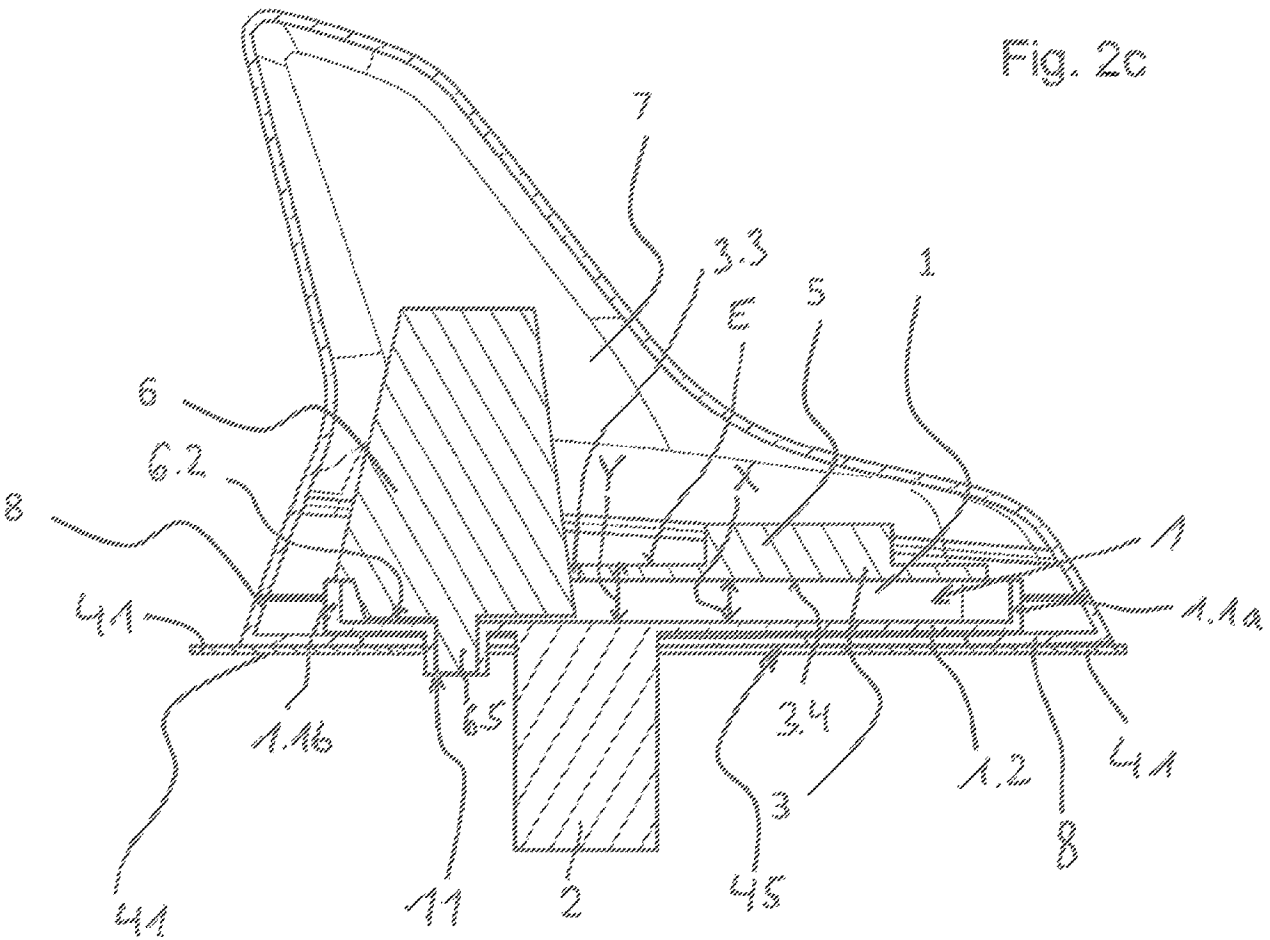
FIG. 2*c* is a vertical section through the example shown in FIGS. 2*a* and 2*b*, but when the cover is in place in the appropriate position in the region of a roof opening.

In the example according to FIGS. 2*a* to 2*c*, the horizontal board 3 is formed having a greater longitudinal extension. Said board is provided, in the centre of the boundary side 3.2 thereof facing the vertical antenna 6, with a slot or locking slot 3.3 made across a specified length, which slot is preferably formed precisely in the vertical plane in which the vertical board 6 is also arranged. The vertical board 6 now engages, by means of a forward vertical board portion 6.3, in said slot 3.3 and can be additionally retained and supported thereby, also mechanically. In addition, two webs 1.4, formed at the rear, are provided in this embodiment, which webs are for example rigidly connected in a mechanical manner to or formed in one piece with the following inner frame portion 1.1*b*. An additional locking slot 10 is formed thereby, in which a rear and in particular lower board portion 6.4 can engage, by means of which the vertical board is also mechanically held and anchored. In this embodiment, too, the lower edge 6.2 of the vertical board 6 is positioned on the base plate 1, i.e. on the upper side 1.2 of the base plate 1 (i.e. the pedestal 1). In this case, the pedestal base (upper side 1.2) of the base plate 1 can act directly as the ground plane. Reference is also made in this regard to the embodiment according to FIGS. 2*a* to 2*c*, which is comparable in this respect.

In this embodiment, the lower edge 6.2 of the vertical board 6 is arranged lower than in the prior art as shown in FIG. 5, by the distance dimension Y. In this case, the dimension Y corresponds to the distance dimension X between the underside 3.4 of the horizontal board 3 and the upper side 1.2 of the base plate 1, plus the thickness dimension of the board 3.

Figure 3:
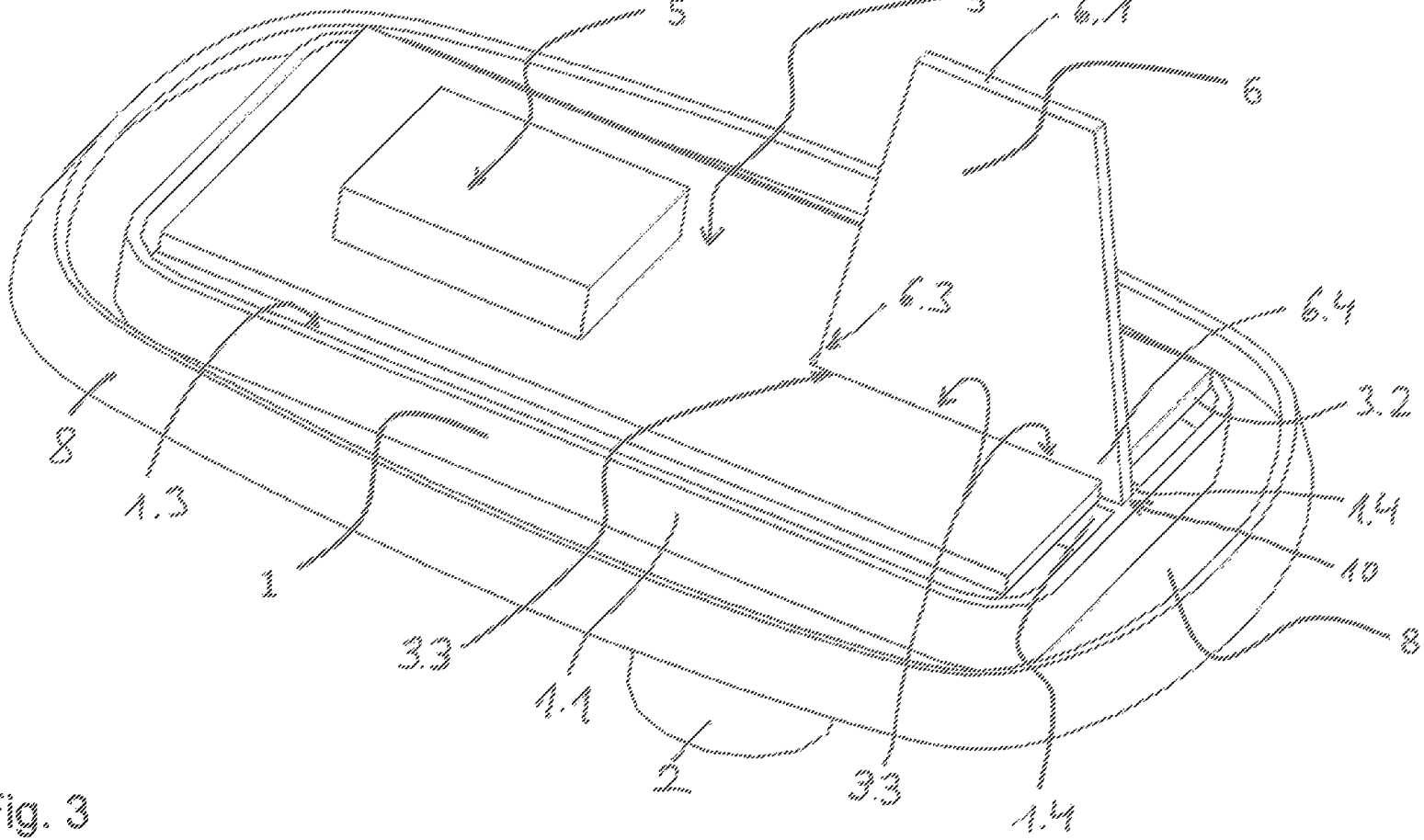
FIG. 3 is a perspective view of an example yet again modified compared with FIG. 1*a* and FIG. 2*a*, when the cover is removed.

In the example according to FIG. 3, the horizontal board 3 shown in FIGS. 2*a* and 2*b* is further lengthened and covers almost the entire interior 1.3 on the base plate inside the circumferential base plate frame 1.1. Consequently, the board slot 3.3 mentioned in FIG. 2*a* is also configured to be longer in this embodiment and has an overall length which may, in some circumstances, correspond to almost the overall length of the vertical board in the lower region thereof. In any case, said board slot 3.3 is sufficiently long for the vertical board to project through said board slot 3.3 and to preferably come into contact, at the lower edge 6.2 thereof, with the bottom 1.2 of the base plate 1. Here, too, the rear retaining slot 10 may be configured, by means of the mentioned two webs 1.4, for additional fixing of the vertical board. In this embodiment, the following portion of the vertical board 6 protrudes beyond the rear transverse side 3.2 of the horizontal board 3 by just a small amount, for example by less than 30%, in particular less than 20%, 15%, 10% or 5%, of the overall length of the horizontal board 3.

Figure 4A:
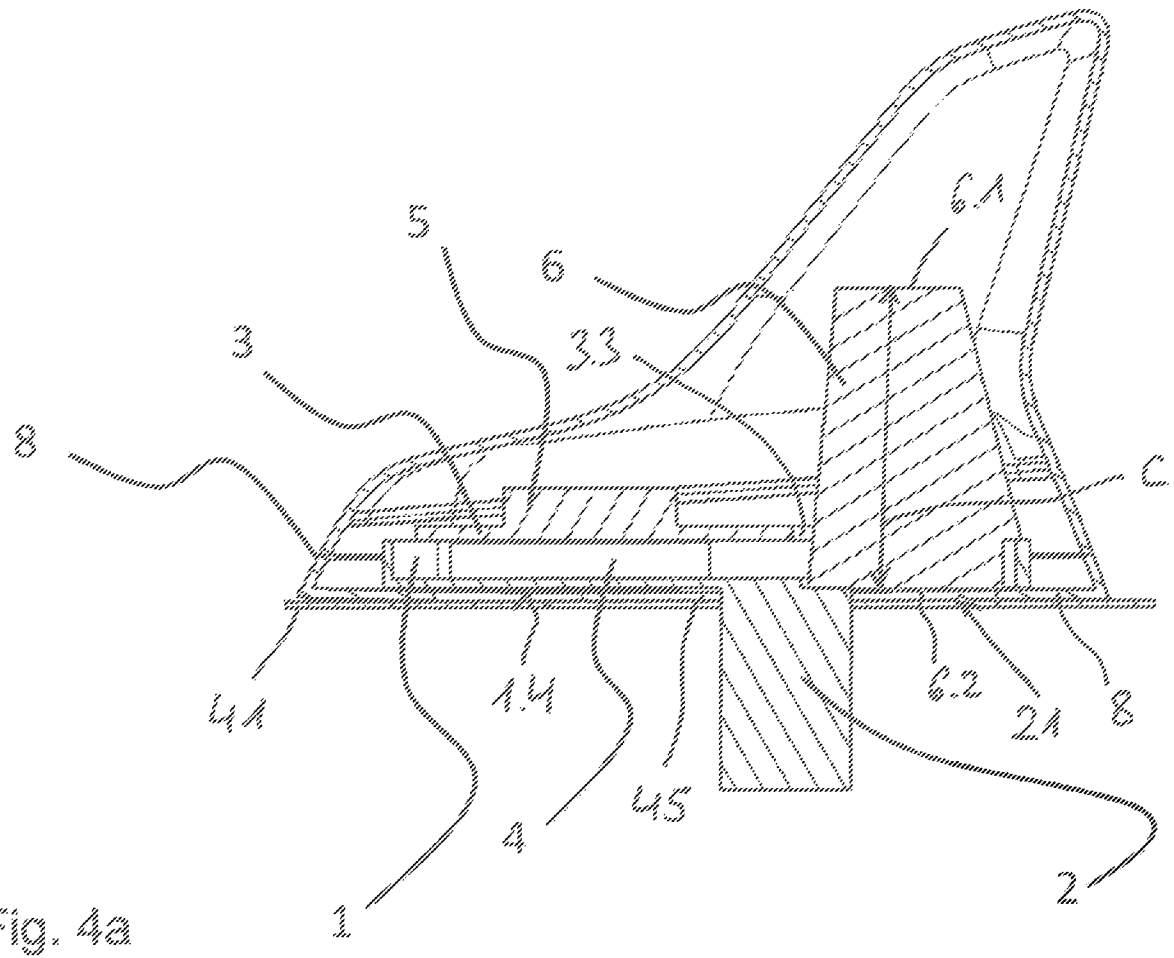
FIG. 4*a* is an embodiment according to the invention, in which the vertical board of the antenna arrangement is arranged such that the lower edge thereof comes to rest approximately at the height of the underside of the pedestal in the region of the roof opening of a vehicle.
Figure 4B:
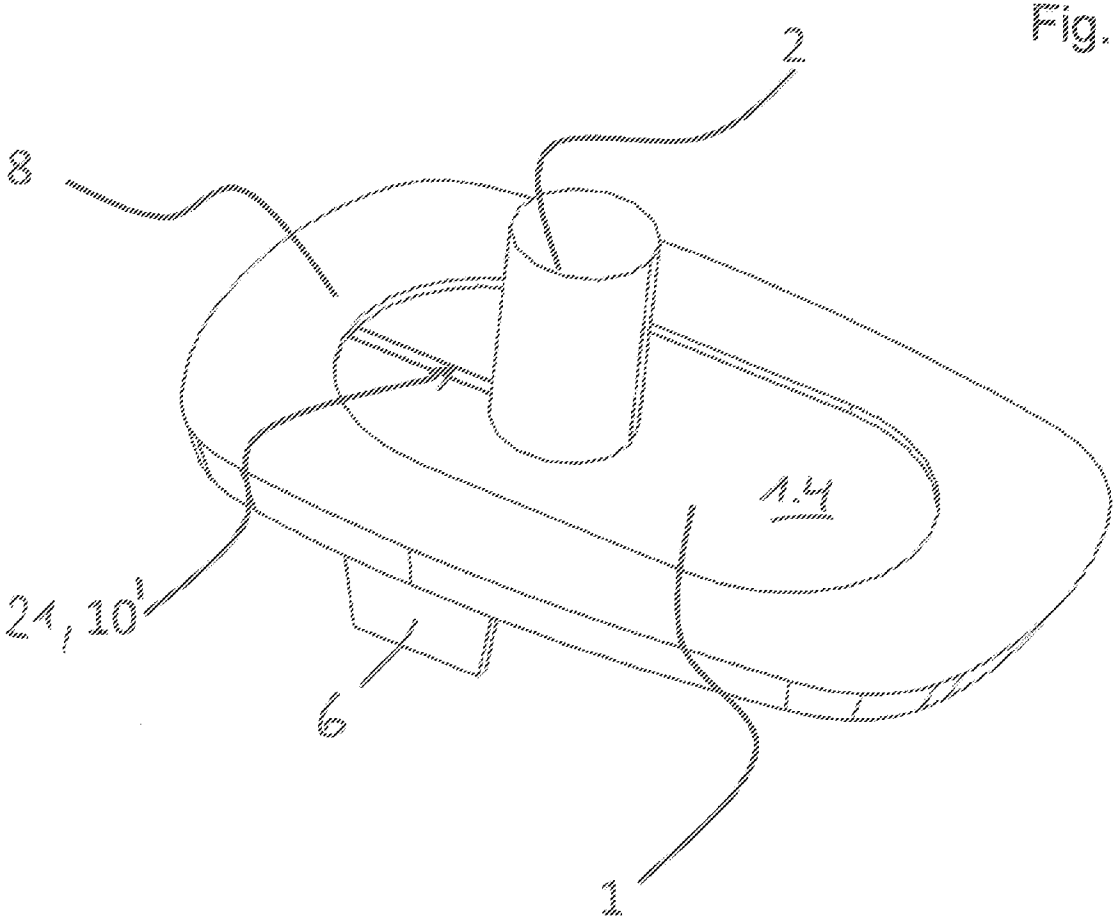
FIG. 4*b* is a view from below of the embodiment according to the invention according to FIG. 4*a*, without the motor vehicle roof.

Another reduction in height or, conversely, a further option for configuring the vertical board having a greater vertical extension (without the need to enlarge the cover) is provided in the embodiment according to the invention according to FIGS. 4*a* and 4*b*.

In the embodiment according to the invention according to FIGS. 4*a* and 4*b*, the base plate 1 is in addition skeletonised. This means that the base plate 1 comprises a base plate recess or base plate opening 21 at least in the region in which the vertical board 6 is provided or positioned. This makes it possible for the vertical board 6 comprising the antenna structure (in particular in the form of a mobile communication antenna) formed thereon to be arranged in such a way that the board 6 protrudes through the base plate 1. In this case, the height dimension C between the base plate underside 1.4 and the board upper edge 6.1 is again smaller than the dimension B, or the overall height of the board 6 can be configured to be larger than in the other examples, even if the upper edge 6.1 is no higher than in the above-discussed variants.

In this case, the level or the plane of the base plate underside 1.4 may also be the height at which the lower edge 6.2 of the vertical board 6 (comprising the antenna structure there) can come to rest. Of course, said lower edge 6.2 may also be slightly higher, i.e. in the region of the thickness of the base material of the base plate 1. The advantage of this embodiment is based on the fact that the lower edge 6.2 of the vertical board can be lower than the level of the upper side 1.2 of the base plate 1.

In the described embodiment, it is possible for the base plate to comprise a base plate extension or base plate recess 21 which is dimensioned to also be sufficiently large in the transverse extension that, in this region, in which the vertical board 6 is positioned, the base plate optionally comprises only the circumferential base plate frame 1.1 and associated fastening means and devices for anchoring the vertical board 6. In this case, the skeletonised base plate may also comprise, in addition to the frame 1.1, a circumferential bottom edge portion adjacent thereto, for example in a width in which a corresponding seal bottom portion 8.4 of the outer circumferential seal 8 is also formed. This means that the base plate 1 comprises a base plate recess 21 as a result of the skeletisation, which recess is formed in the following region of the base plate, and overlaps, at least substantially, with the recess 8.3 in the bottom region of the seal 8.

If the base plate recess 21 is as large as described, the motor vehicle roof 41, which comes to rest in this region directly beneath the base plate recess 21, forms the ground plane.

However, by contrast, the base plate recess 21 may also be comparatively small, in particular formed only as a slot, as shown in the view from below according to FIG. 4*b*. In this case, as an extension of the described rear slot 10, a slot-like recess 10' is provided as a base plate recess 21, which is dimensioned to be at least sufficiently wide such that, if necessary, the lower edge 6.2 of the vertical board 6 may be positioned as far as the plane of the underside 1.4 of the base plate. In this case, the bottom of the base plate 1 forms the ground plane.

In the context of the described embodiments, the vertical board 6 can thus be positioned such that the lower edge 6.2 thereof is arranged lower, by a dimension Z, than in the solution known up to now from the prior art (shown in FIG. 5).

This ensures that the base plate—as is also the case in the other embodiments—can typically be mounted on a motor vehicle roof and that a cover can be attached thereto in a sealing manner, including the seal 8 necessary for this attachment, as described and shown.

Due to the construction of the antenna arrangement according to the embodiment as set out, it is possible for the lower edge of the vertical board 6 or the vertical antenna 6 arranged thereon to come to rest beneath the plane E, which is determined by the horizontal board 3. Otherwise, according to the prior art according to FIG. 5, the lower edge 6.2 of the vertical board 6 comes to rest on the upper surface, i.e. on the upper side of the horizontal board 3.

If said horizontal board is typically arranged for example 5 mm above the bottom 1.2 of the base plate 1, as a result of the described embodiments of the invention, the lower edge of the vertical board can be lower by up to a dimension Y of for example 5 mm, and in the variant in which a corresponding recess or opening 21 is formed in the base plate 1 said lower edge can be arranged lower by an overall dimension Z (FIG. 5), by the material thickness of the bottom of the base plate 1 and the additionally effective sealing 8.

Purely for the sake of completeness, it is noted that the fastening and mounting arrangement of the vertical board can also be carried out in such a way that the lower edge thereof is lower than for example the plane E, i.e. the upper surface of the horizontal board 3, although in such a way that the lower edge 6.2 of the vertical board 6 comes to rest at least slightly above the bottom 1.2 of the base plate 1. This possible distance between the lower edge 6.2 of the vertical board 6 and the bottom 1.2 of the base plate 1 should therefore, in the context of the invention, be of less than 4 mm, in particular less than 3 mm, 2 mm, 1 mm or 0.5 mm, in order to achieve the desired advantages according to the invention of a reduction in the height of the overall arrangement, or in order to accommodate a vertically taller board under a cover of the same size.

In the context of the invention, a further reduction in the overall height is also even possible. This is because the solution according to the invention lastly also comprises a modular system with regard to the construction of the roof-mounted antenna arrangement.

Specifically, depending on the number and type of desired communication services, in the context of the invention the described roof-mounted antenna can be configured according to different variants which may range between a "minimal design" and a "complete configuration". The "minimal design" is a configuration completely without the horizontal board 3 and contains only the described vertical board 6 and the antenna formed thereon, in particular a mobile communication antenna, for example in the form of a GSM antenna. The roof-mounted antenna arrangement according to the invention consists, in this case, of the base plate 1, the vertical board 6 attached thereto comprising the antenna structures for mobile communication, and circuit components which may be provided, as well as the cover 7 arranged thereover.

In order to lock the vertical board 6, in the context of the described embodiments, all suitable means and measures may be provided, for example positive and/or non-positive fastening means may be used. Said means may comprise, for example, the slot 3.3 in the board 3 and/or the slot 10 or the wraparound 14 together with the slot 10 located therein at the border 1.1 of the base plate 1 and/or an integrally formed cuff 11 comprising a slot therein (FIG. 1*c*), which cuff extends from the underside of the base plate 1 beside the fastening means 2 through the opening in the roof surface. A board projection 6.5, which protrudes beyond the lower edge 6.2 of the board 6 for example in a tongue-shaped manner, can engage in said slot of the cuff 11, it then being possible for the cuff 11 to be deformed or caulked, and the board projection 6.5 engaging in the cuff is held thereby in a non-positive and/or positive fit.

A prerequisite for arranging the cuff 11 on the underside of the base plate 1 is that it is possible for the cuff 11 to also be guided through the opening 45 in the roof. Then said cuff can for example at the same time advantageously serve to adjust the base plate 1 via the roof opening 45 if the contour of the roof opening 45 is correspondingly designed.

Instead of locking means 11 in the form of a downwardly projecting cuff, two small web portions 1.4 projecting upwards beyond the surface of the base plate and forming a slot 10 are also suitable for holding the board 6.

The slot formations on the base plate are caulked in order to hold the board.

The invention claimed is:

1. Roof-mounted antenna arrangement for motor vehicles, comprising:

a base plate made of an electrically conductive material or a dielectric material which is coated completely or in part with an electrically conductive material, a vertical board made of a dielectric material, a mobile communication antenna structure formed on the vertical board, a cover-like cap made of a dielectric material, which covers the mobile communication antenna structure and is fastened at least indirectly to the base plate, and a cable outlet arranged on the underside of the base plate for laying cables leading to secondary components in a vehicle interior, wherein the vertical board is positioned such that the lower edge thereof is arranged beneath an upwardly pointing bottom formed by the bottom of the base plate, in a region of a recess formed in the base plate; and wherein the base plate has a frame which at least partially surrounds the base plate, the frame defining a locking slot, the vertical board being held in the locking slot which is formed on the base plate frame which surrounds the base plate at least in portions.

2. Roof-mounted antenna arrangement according to claim 1, wherein the vertical board comprises a board projection protruding downwards over the lower edge of the vertical board formed on the vertical board, which projection protrudes downwards over the underside of the base plate and/or the underside of a seal.

3. Roof-mounted antenna arrangement according to claim 2, wherein, for fixing the vertical board, the downwardly protruding board projection engages in a cuff which is connected to the bottom of the base plate and is provided with a receiving opening, which cuff is deformable in order to fix the vertical board.

4. Roof-mounted antenna arrangement according to claim 1, wherein a supply point for the vertical board is in the region of the lower edge thereof.

5. Roof-mounted antenna arrangement according to claim 4, wherein the lower edge of the vertical board is at the height of the underside of the base plate or at the height of the underside of a seal on which the base plate is arranged.

6. Roof-mounted antenna arrangement according to claim 4, wherein the supply point for the vertical board is arranged beneath the plane of the board.

7. Roof-mounted antenna arrangement according to claim 1, wherein the base plate comprises fastening means on the underside thereof, in a non-skeletonised region thereof, for locking on the motor vehicle side.

8. Roof-mounted antenna arrangement according to claim 7, wherein the base plate is formed as a monolithic injection-moulded part.

9. Roof-mounted antenna arrangement according to claim 1, wherein the lower edge of the vertical board is arranged at a distance of less than 5 mm above the bottom of the base plate or above the underside of a seal on and within which the base plate is arranged.

10. Roof-mounted antenna arrangement for motor vehicles, comprising:

a base plate made of an electrically conductive material or a dielectric material which is coated completely or in part with an electrically conductive material, a vertical board made of a dielectric material, a mobile communication antenna structure formed on the vertical board, a cover-like cap made of a dielectric material, which covers the mobile communication antenna structure and is fastened at least indirectly to the base plate, and a cable outlet arranged on the underside of the base plate for laying cables leading to secondary components in a vehicle interior, wherein the vertical board is positioned such that the lower edge thereof is arranged beneath an upwardly pointing bottom formed by the bottom of the base plate, in a region of a recess formed in the base plate, wherein a horizontal board extending parallel to the base plate and arranged so as to be spaced apart from the bottom of the base plate is provided, said horizontal board ending before the vertical board or comprising a recess in the region of the vertical board, which recess is penetrated by the vertical board, wherein the recess in the horizontal board is formed as a locking slot on a side facing the vertical board, in which slot a forward board portion of the vertical board engages.

11. Roof-mounted antenna arrangement according to claim 1, wherein the vertical board is held in a positive and/or non-positive fit.

12. Roof-mounted antenna arrangement according to claim 1, wherein the base plate is configured in a skeletonised manner in such a way that a recess is provided in the region of the vertical board in the bottom of the base plate, the width and length of which recess are dimensioned such that the lower edge of the vertical board can be positioned so as to engage in said recess or to penetrate said recess.

13. Roof-mounted antenna arrangement according to claim 1, wherein the recess in the bottom of the base plate is formed at least as a slot, which is dimensioned such that the lower edge of the vertical board protrudes through said slot-like recess or engages therein.

14. Roof-mounted antenna arrangement for motor vehicles, comprising:

a base plate made of an electrically conductive material or a dielectric material which is coated completely or in part with an electrically conductive material, a vertical board made of a dielectric material, a mobile communication antenna structure formed on the vertical board, a cover-like cap made of a dielectric material, which covers the mobile communication antenna structure and is fastened at least indirectly to the base plate, and a cable outlet arranged on the underside of the base plate for laying cables leading to secondary components in a vehicle interior, wherein the vertical board is positioned such that the lower edge thereof is arranged beneath an upwardly pointing bottom formed by the bottom of the base plate, in a region of a recess formed in the base plate, wherein a horizontal board is arranged at a distance above the bottom of the base plate, the upper side of which board defines a plane, and the vertical board is arranged such that the lower edge thereof below the plane defined by the horizontal board.

* * * * *